United States Patent [19]

Dufresne

[11] Patent Number: 4,929,191

[45] Date of Patent: May 29, 1990

[54] BATTERY CABLE CLAMP APPARATUS

[76] Inventor: Raymond A. Dufresne, 2937 E. Oraibi Dr., Phoenix, Ariz. 85024

[21] Appl. No.: 355,494

[22] Filed: May 23, 1989

[51] Int. Cl.[5] ..... H01R 11/26

[52] U.S. Cl. ..... 439/429

[58] Field of Search ..... 439/428, 429, 727, 754, 439/756, 765, 770, 771, 772

[56] References Cited

U.S. PATENT DOCUMENTS 4,576,430 3/1986 Dufresne ..... 439/429

*Primary Examiner*—Joseph H. McGlynn

*Attorney, Agent, or Firm*—H. Gordon Shields

[57] ABSTRACT

Battery cable clamp apparatus includes a dielectric and corrosive resistant block having a bore which receives a battery terminal post, and an intersecting bore into which a battery cable connector element extends. The two bores intersect at the battery terminal post. A screw element is used to help provide electrical connection between the battery cable, which extends into the connector element, and between the connector element and the battery post by means of a third bore extending into the dielectric block.

13 Claims, 1 Drawing Sheet

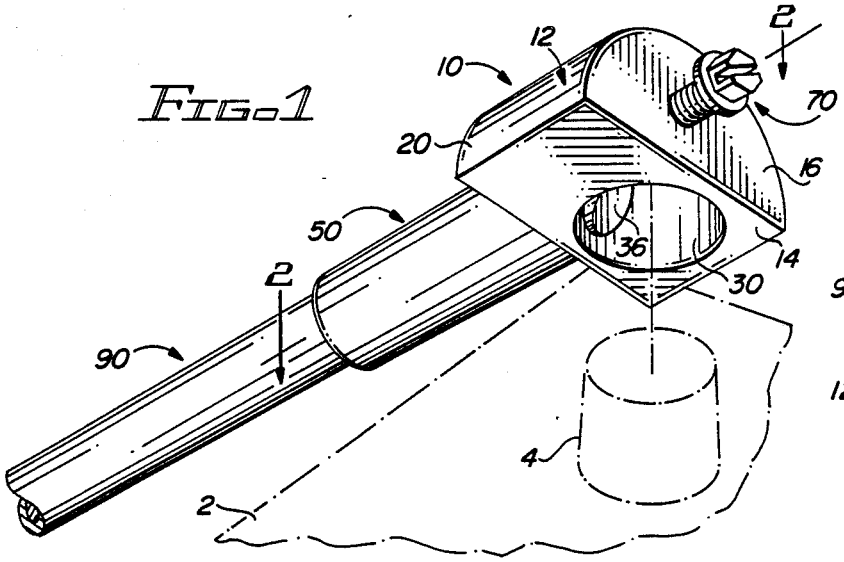
FIG. 1
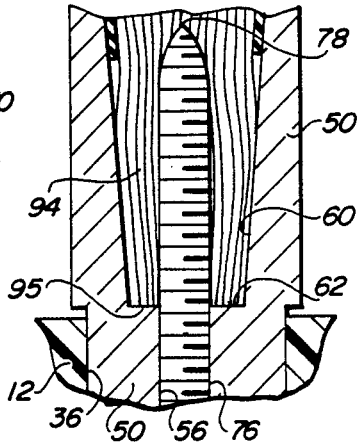
FIG. 7
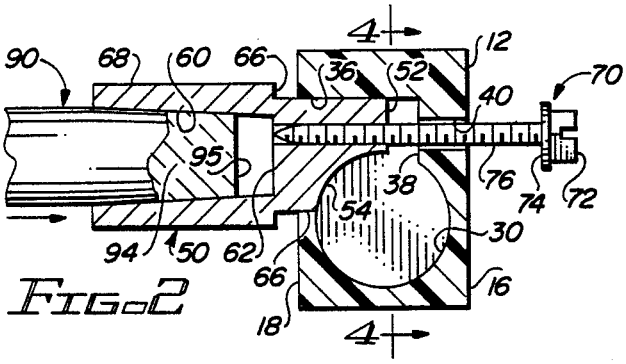
FIG. 2
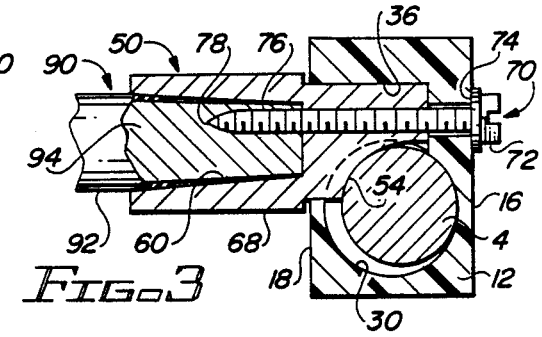
FIG. 3
FIG. 4
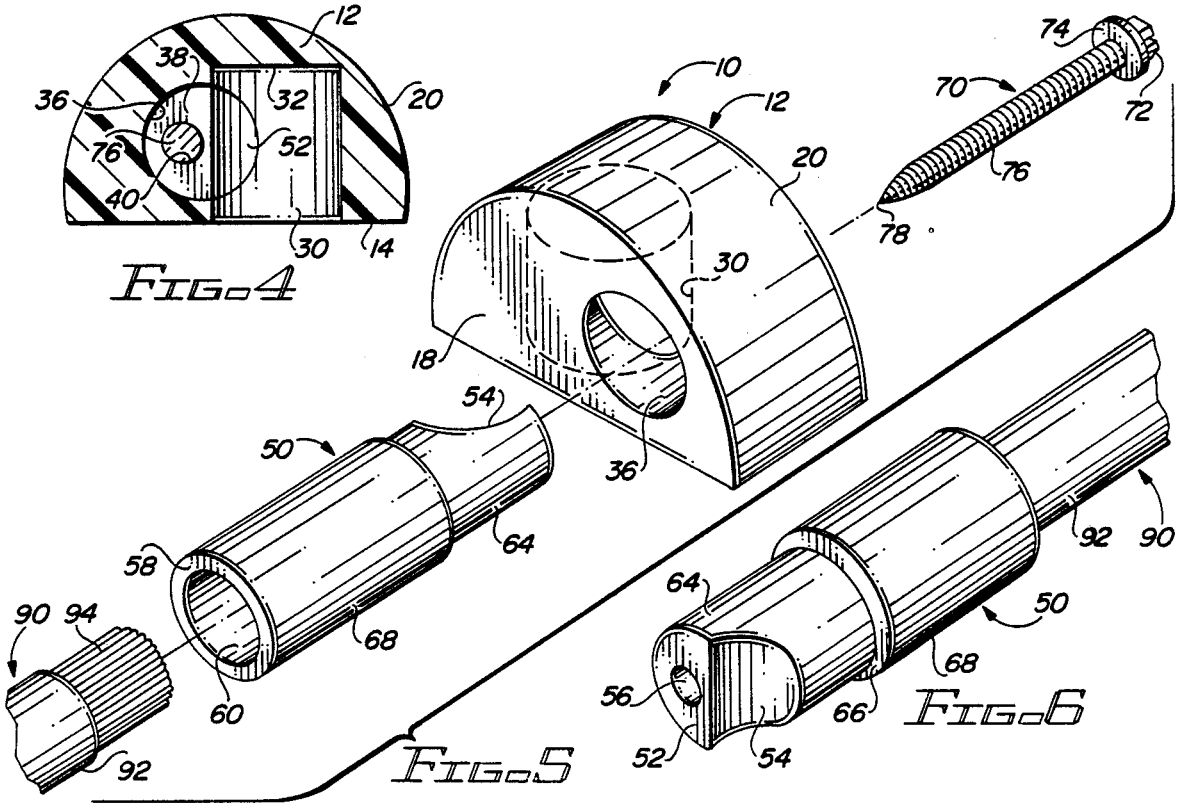
FIG. 5
FIG. 6

BATTERY CABLE CLAMP APPARATUS

BACKGROUND OF THE INVENTION

1. Field of the Invention

This invention relates to apparatus for connecting a battery cable to a battery post and, more particulary, to a cable connector for substantially completely enclosing a battery post with a non-metallic covering, and the battery post is connected to the battery cable through a metallic element secured within the housing.

2. Description of the Prior Art

U.S. Pat. No. 4,576,430, the inventor of which is the inventor of the present invention, discloses a snap clamp apparatus for connecting a battery cable to a battery terminal. The snap clamp apparatus utilizes two dielectric elements, one of which extends onto the battery post, and which includes conductive elements to which a battery cable is connected. A clamp element then extends over the bottom block.

U.S. Pat. No. 4,372,636, the inventor of which is also the inventor of the present apparatus, discloses the use of plastic caps to secure battery cables to battery terminal posts.

An underlying problem in the connection of any battery post to a battery cable is the inherent corrosion problem resulting from the venting of corrosive gases from the battery. Without some type of protection, the gases ultimately cause corrosive salts to form on the contact area or interface between the battery cable and the battery post. This, in turn, increases the resistance in the battery circuit and ultimately results in some type of battery failure.

The "solution" to the problem discussed on the preceding paragraph is, obviously, to seal the connection, as much as possible, between the battery post and the battery cable to prevent the buildup of the corrosive material between the battery post and the battery cable. Moreover, the protection must be extended along the battery cable a distance sufficiently to prevent the corrosive material from contacting copper wire typically utilized in battery cables. When the corrosive material contact the copper wire, the wire is slowly corrosively eaten. This, of course, in turn results in decreasing ability of the wire to conduct the current demanded of it, and ultimately leads to the failure of the cable simply due to the corrosive materials eating the cable away.

The apparatus of the present invention utilizes a single dielectric and corrosive resistant element for connecting a battery cable to a battery post. The battery post is substantially completely covered by the dielectric and corrosive resistant element. Good electrical contact is provided and maintained for the battery cable, its connective element, and the battery post.

SUMMARY OF THE INVENTION

The invention described and claimed herein comprises a dielectric and corrosive resistant block which comprises a cap for a battery post. A battery cable extends into the cap through a conductive element. The conductive element and the battery post are disposed in intersecting bores within the cap. A screw extending into the intersecting bores contacts the electrical connector and the battery cable to both urge the battery cable and its connector into electrical contact, and at the same time urges the connector into electrical contact with the battery post.

Among the objects of the present invention are the following:

To provide new and useful apparatus for connecting a cable to a battery post;

To provide new and useful battery cable clamp apparatus;

To provide new and useful battery cap apparatus for covering a battery post and for connecting the battery post to a battery cable;

To provide new and useful battery clamp apparatus utilizing a screw element to urge electrical contact between a battery cable and a battery connector element and between a battery connector element and the battery post; and To provide new and useful battery cable clamp apparatus utilizing a dielectric block having intersecting bores.

BRIEF DESCRIPTION OF THE DRAWING

FIG. 1 comprises a perspective view of the apparatus of the present invention.

FIG. 2 is a view in partial section taken generally along line 2—2 of FIG. 1.

FIG. 3 is a view in partial section illustrating consecutively the operation of the elements illustrated in FIG. 2.

FIG. 4 is a view in partial section taken generally along line 4—4 of FIG. 2.

FIG. 5 is an exploded perspective view of the apparatus of the present invention.

FIG. 6 is a perspective view of a portion of the apparatus of the present invention.

FIG. 7 is a view in partial section of a portion of the apparatus of the present invenion.

DESCRIPTION OF THE PREFERRED EMBODIMENT

FIG. 1 is a perspective view of battery cable clamp apparatus 10 of the present invention shown disposed above a battery 2 and a battery post 4. The battery 2 and the battery post 4 are shown in phantom in FIG. 1. FIG. 2 is a view in partial section of the battery cable clamp apparatus 10 of FIG. 1, taken generally along line 2—2 of FIG. 1. FIG. 3 is a view in partial section sequentially illustrating the cooperation of the elements illustrated in FIG. 2.

The battery cable clamp apparatus 10 includes a block 12 which is made of dielectric and corrosion resistant material, such as some type of plastic. A conductive connector element 50 receives a battery cable 90 and extends into the block 12. A screw 70 is used to secure the connector 50 to the block 12, and is also used to help secure the cable 90 to the connector 50.

FIG. 4 is a view in partial section taken generally along line 4—4 of FIG. 2 through the block 12. FIG. 5 is an exploded perspective view of the apparatus 10, including the block 12, the connector 50, the screw 70, and the cable 90. FIG. 6 is a perspective view of the connector 50, with the cable 90 extending into it. FIG. 7 is a view in partial section through a portion of the block 12, the connector 50, and the cable 90, with a portion of the screw 70 extending through the connector 50, and into a portion of the cable 90. For the following discussion, reference will be made to FIGS. 1–7.

The block 12 includes a generally flat bottom surface 14 which is preferably disposed on the top surface of the battery 4. The block 12 also includes a front surface or face 16 and a rear face or surface 18. The front and rear surfaces or faces 16 and 18 are generally parallel to each other. The block 12 further includes a top surface 20, which is preferably generally round or semicircular in configuration.

Extending upwardly into the block 12 from the bottom surface 14 is a bore 30. The bore terminates within the block 12 at an end 32. The bore 30 is slightly tapered to receive the tapered battery post 4 of the battery 2. The overall length or height of the bore 30 is preferably about the same as the overall height of the battery post 4 so as to allow the battery post 4 to be virtually completely disposed within the bore 30. In this manner, the bottom surface 14 of the block 12 will be disposed on or very closely adjacent to the top surface of the battery 2.

Extending into the block 12 from the rear surface 18 is a bore 36. The bore 36 terminates in an end 38 adjacent to the bore 30. The bores 30 and 36 are intersecting bores, but, as best shown in FIGS. 2, 3, and 4, the bores 30 and 36 do not intersect along their longitudinal axes. Rather, the bores 30 and 40 are somewhat offset.

A third bore, a bore 40, extends into the block 12 from the front surface or face 16. The bore 40 is aligned with the bore 36, but the alignment is not coaxial. Rather, the longitudinal axis of the bore 40 is offset slightly from the longitudinal axis of the bore 36. As shown in FIGS. 2 and 3, the bores 36 and 40 are aligned off the center line or longitudinal axis of the bore 36. The bore 40 does not intersect the bore 30.

The bore 36 receives a portion of the connector 50, and the bore 40 receives the screw 70. The cooperation between the connector 50 and the screw 70 will be discussed on detail below.

The connector 50 is of a generally cylindrical configuration but with a cutout or a curved or relieved portion 54 extending into the connector. The connector 50 includes a front end or face 52, and the curved portion 54 intersects the front face 52. The curved or relieved portion 54 is adapted to be disposed against the battery post 4, as best shown in FIG. 3. The curved or relieved portion 54 is roughly a ninety degree arcuate segment to provide maximum contact between the connector 50 and the battery post 4. There will preferably be a slight taper on the relieved portion 54 to match the taper on the battery post.

Extending into the connector 50 from the front end 52 is a bore 56. The bore 56 receives a portion of the screw 70, as will be discussed below.

The connector 50 also includes a rear end 58. The end 58 is generally parallel to the end 52.

A bore 60, which is preferably an inwardly tapering bore, extends into the connector 50 through the end 58. The bore 60 terminates in an end wall 62 within the connector 50. The bore 56 connects with the bore 60 through the end 62. As indicated above, and as shown in FIGS. 2, 3, 4, and 6, the bore 65 is not centrally located, or is not located on the longitudinal axis of the connector 50. Rather, the bore 56 is offset from the longitudinal axis of the connector 50 so as to not interfere with the relieved portion 54 which contacts the battery post 4. This is best shown in FIG. 3.

The connector 50, obviously, is an electrically conductive element, preferably made out of lead or a similar metal.

The screw 70 includes a head 72 which may be slotted to receive a screwdriver blade. The head could also include a hexagonal outer configuration to allow a socket to be secured to the screw for purposes of inserting or removing the screw. Obviously, instead of a diametrical slot as shown, any other type of slot could also be utilized, such as a Phillips head slot arrangement, etc.

The rear of the head 72 comprises a relatively flat face or shoulder 74. A threaded shank 76 extends outwardly, away from the head 72 from the face or shoulder 74. The threaded shank 76 terminates in a pointed tip 78.

The battery cable 90 includes an outer sheath 92, which is a dielectric material, and preferably or generally a plastic material, relatively flexible and relatively impervious to oil, grease, corrosive elements, and the like, typically found in the environment of a battery, an engine, etc. The sheath 92 is disposed about copper strands 94. Typically, battery cables are made of stranded copper and sheathed in a plastic, dielectric material. The copper strands 94 extend into the bore 60 all the way to the end 62 of the bore 60. The sheath 92 preferably extends only a relatively short distance into the bore 60.

In usage, the cable 90 is inserted into the connector 50 after a length of strands 94 is bared the sheath 92. It will be noted that the bore 60 is preferably tapered so as to provide a good, tight fit with the copper strands 94 of the cable 90.

It will be noted that cable strands 94 are illustrated rather discriptively in FIGS. 5 and 7. However, for convenience and clarity, the cable strands 94 are shown differently in FIGS. 2 and 3. The showing in FIGS. 2 and 3 is generally merely a schematic illustration in which the cable is hatched as solid metal.

With the cable 90 disposed in the connector 50, the connector 50 is then extended into the bore 36. The connector 50 is oriented with respect to the block 12 so that the relieved portion 54 will be disposed at the juncture of the bores 32 and 36, as best shown in FIGS. 2 and 3.

With the cable 90 disposed in the block 12, the block 12 is then placed over the post 4 of the battery 2. The battery post 4 extends into the bore 30 until either the top of the post 4 bottoms out on the end 32 of the bore 30, or until the bottom surface 14 of the block 12 is disposed on the top surface of the battery 2.

FIGS. 2, 3, and 5 illustrate the securing of the block 12 and the cable 90 to the battery post 4 by means of the screw 70. The cable 90 is assembled to the block 12, as shown in FIG. 2. The cable 90 extends into the bore 60, as indicated by the large arrow in FIG. 2. The copper strands 94 include a front end 95. The cable 90 is extended into the bore 60 until the front end 95 bottoms out or contacts the end 62 of the tapered bore 60.

With the block 12 disposed on the post 4, or with the post 4 extending into the bore 30 of the block 12, the screw 70 is then tightened. As indicated in the Figures, the screw 70, or rather the shank 76 of the screw 70, extends through the bore 40 of the block 12, and into the bore 36 of the block 12 and into the bore 56 of the connector 50. The tip 78 of the shank 76, which is relatively pointed, then extends into the copper strands 94.

As best indicated in FIGS. 2 and 3, the bore 40 in the block 12 is slightly larger in diameter than is the outer diameter of the threaded shank 76 of the screw 70. However, the outer diameter of the shank 76 of the screw 70 is substantially the same as, or slightly greater than the diameter of the bore 56 in the connector 50. Accordingly, as the screw 70 is rotated, its threads lock into the bore 56 of the connector 50. Then, as the point 78 extends into the copper strands 94, the screw 70 and its threaded shank 76 cause several different events to occur.

The threaded shank 76 of the screw 70 draws the connector 50 inwardly with respect to the block 12, so that the end 52 of the connector 50 abuts the end 38 of the bore 36, or causes the connector to move as close as the end 52 can come to the end 38, depending on the diameter of the post 4. The screw 70 urges the connector 50, and particularly the curved or relieved portion 54, into electrical contact with the outer surface of the post 4. This is shown in FIG. 3.

At the same time that the screw 70 is urging, and locking, the connector 50 into engagement with the post 4, the screw 70 also secures the connector 50 to the block 12. Moreover, the screw 70 secures or locks the cable 90 to the connector 50. As will be recalled, the bore 60 is tapered inwardly, so that the diameter of the bore 60 adjacent to the end wall 62 has a lesser diameter than the bore 60 has remote from the end 62. As best shown in FIG. 7, the screw 70, by virtue of its threaded shank 76, moves or urges the strands 94 of the copper cable 90 outwardly into engagement with the bore 60. The strands 94 of the cable 90 are accordingly securely held or locked to the connector 50. Thus, at the same time the connector 50 is securely held to the block 12, the connector 50 is also locked or held onto the post 4, and the cable 90 is secured to the connector 50.

Accordingly, it will be understood that the engagement between the threaded shank 76 of the screw 70 with the strands 94 of the cable 90 results in the strands 90 becoming essentially locked to the screw 70 such that there is actually a three way lock provided. The screw 70 is locked to the cable 90, the screw 70 is also locked to the conductor 50, and the cable 90 and the conductor 50 are locked by the screw 70 to the block 12. A fourth locking arrangement occurs by the locking engagement between the connector 50 and the post 4. The post 4 essentially is secured in an almost vice-like locking arrangement between the bore 30 and the cutout 54 of the connector 50 by the screw 70.

For convenience, there may be an external shoulder 66 on the connector 50. The shoulder 66 is simply the difference between two diameters or two cylindrical portions 64 and 68 of the connector 50 for convenience in providing a relatively thick outer wall for the cylindrical portion 68 of the connector 50 outside the block 12 and which portion of the connector includes the largest diameter portion of the bore 60. The shoulder 66 is not designed to abut the end face 18 of the block 12. Such abutting relationship could hinder or interfere with the locking arrangement discussed above and with the electrical contact between the connector 50 and the terminal post 4. For the same reasons, it is preferable that the end face 52 of the connector 50 does not contact the end wall 38 of the bore 36.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Battery cable clamp apparatus for securing a cable to a battery post, comprising, in combination:

dielectric block means for covering the battery post, including a dielectric block, a first bore in the dielectric block for receiving a battery post, and a second bore in the dielectric block intersecting the first bore;

conductive connector means extending into the second bore of the dielectric block means for connecting the cable to the battery post, including a first connector bore for receiving a portion of the cable, and an electrical contact portion extending into and movable in the first bore in the block and contacting the battery post to provide electrical contact between the connector means and the battery post; and means for securing the conductive connector means to the dielectric block and to the battery post.

2. The apparatus of claim 1 in which the means for securing the conductive connector means to the dielectric block and to the battery post includes screw means extending into the dielectric block and into the conductive connector means.

3. The apparatus of claim 2 in which the dielectric block means further includes a third bore aligned with communicating with the second bore, and the screw means extends through the third bore and into the conductive connector means.

4. The apparatus of claim 3 in which the conductive connector means further includes a second connector bore communicating with the first connector bore and with the third bore of the dielectric block and the screw means extends into the second connector bore.

5. The apparatus of claim 4 in which the screw means further extends through the second connector bore and into the cable disposed in the first connector bore to secure the cable to the conductive connector means and to secure the conductive connector means to the dielectric block.

6. The apparatus of claim 1 in which the dielectric block means further includes a front surface, a rear surface, and a bottom surface; and the first bore extends into the dielectric block from the bottom surface, the second bore extends into the dielectric block from the rear surface, and the means for securing the conductive connector mwans to the dielectric block extends into the dielectric block from the front surface.

7. The apparatus of claim 6 in which the means for securing the conductive connector means to the dielectric block includes a screw having a head disposed adjacent to the front surface and a shank extending into the dielectric block and into the conductive connector means to urge the electrical contact portion against the battery post when the head is rotated.

8. The apparatus of claim 6 in which the dielectric block means further includes a third bore extending from the front surface to the second bore, and the screw extends through the third bore and into the first connector bore of the conductive connector means to secure the cable portion disposed therein to the conductive connector means.

9. The apparatus of claim 1 in which the conductive connector means further includes a first cylindrical portion extending into the second bore of the dielectric block and a second cylindrical portion disposed outside the dielectric block.

10. The apparatus of claim 1 in which the first connector bore is tapered for enhancing electrical contact between the cable extending into first connector bore and the conductive connector means.

11. The apparatus of claim 1 in which conductive connector means further includes a second connector bore communicating with the first connector bore, and the means for securing the conductive connector means to the dielectric block extends through the dielectric block, through the second connector bore and into the cable portion disposed in the first connector bore.

12. The apparatus of claim 1 in which the means for securing the conductive connector means to the dielectric block and to the battery post further secures the cable to the conductive connector means.

13. The apparatus of claim 12 in which the dielectric block means further includes a third bore aligned with the second bore, and the means for securing the conductive connector means to the dielectric block and to the battery post and the cable to the conductive connector means includes a screw extending through the third bore and into the conductive connector means and the cable.

* * * * *